US009531082B2

(12) United States Patent
Jonsson et al.

(10) Patent No.: US 9,531,082 B2
(45) Date of Patent: Dec. 27, 2016

(54) ANTENNA ARRANGEMENT

(75) Inventors: Stephan Jonsson, Kista (SE); Dan Karlsson, Kista (SE); Gregor Lenart, Kista (SE); Pontus Forsman, Kista (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 522 days.

(21) Appl. No.: 13/881,568

(22) PCT Filed: Jun. 21, 2011

(86) PCT No.: PCT/SE2011/050816

§ 371 (c)(1),
(2), (4) Date: Nov. 20, 2013

(87) PCT Pub. No.: WO2012/057674

PCT Pub. Date: May 3, 2012

(65) Prior Publication Data

US 2014/0062826 A1 Mar. 6, 2014

(30) Foreign Application Priority Data

Oct. 28, 2010 (SE) ..... 1051126

(51) Int. Cl.

| | |
|---|---|
| ***H01Q 21/00*** | (2006.01) |
| ***H01Q 1/52*** | (2006.01) |
| ***H01Q 1/24*** | (2006.01) |
| ***H01Q 19/02*** | (2006.01) |
| ***H01Q 21/06*** | (2006.01) |
| ***H01Q 21/26*** | (2006.01) |
| ***H01Q 19/10*** | (2006.01) |
| ***H01Q 19/18*** | (2006.01) |

(52) U.S. Cl.

CPC ..... *H01Q 21/00* (2013.01); *H01Q 1/246* (2013.01); *H01Q 19/023* (2013.01); *H01Q 19/10* (2013.01); *H01Q 19/18* (2013.01); *H01Q 21/062* (2013.01); *H01Q 21/26* (2013.01)

(58) Field of Classification Search

CPC ..... H01Q 1/38
USPC ..... 343/841, 836
See application file for complete search history.

(56) References Cited

U.S. PATENT DOCUMENTS

| | | | | |
|---|---|---|---|---|
| 5,952,983 A | | 9/1999 | Dearnley et al. | |
| 6,028,563 A | * | 2/2000 | Higgins | 343/797 |
| 6,034,649 A | | 3/2000 | Wilson et al. | |

(Continued)

FOREIGN PATENT DOCUMENTS

| | | | |
|---|---|---|---|
| EP | 1246298 | A1 | 10/2002 |
| WO | WO2004051796 | A1 | 6/2004 |
| WO | WO2009041895 | A1 | 4/2009 |

OTHER PUBLICATIONS

PCT/SE2011/050816 International Search Report, Dec. 1, 2012, Patent—och registreingsverket Box 5055 S-102 42 Stockholm, Sweden.

*Primary Examiner* — Graham Smith
(74) *Attorney, Agent, or Firm* — The Jansson Firm; Pehr B. Jansson

(57) ABSTRACT

(EN)Antenna arrangement comprising at least two discrete antennas (1, 2) mechanically attached to each other to forma combined base station antenna (6), wherein at least two discrete antennas (1, 2) in said combined base station antenna (6) are located alongside each other, wherein a conducting element (10) is arranged between the alongside each other located discrete antennas (1, 2).

18 Claims, 7 Drawing Sheets

(56) References Cited

U.S. PATENT DOCUMENTS

2006/0038736 A1 2/2006 Hui et al.

* cited by examiner

ANTENNA ARRANGEMENT

BACKGROUND AND SUMMARY

The present invention relates to an antenna arrangement comprising several base station antennas mechanically attached to each other. Such an arrangement is henceforth termed combined antenna and the antennas forming the combined antenna are called discrete antennas.

Cellular network operators often have licenses for more than one type of system, e.g. $2^{nd}$ generation systems such as GSM or CDMA, $3^{rd}$ generation cellular systems such as WCDMA, CDMA 1×EV-DO or TD-SCDMA, or $4^{th}$ generation cellular systems such as LTE or IEEE16-m (WiMAX). Usually, a specific frequency band is allocated for each cellular system type, but in some cases different cellular systems can operate on the same band. For cost and other reasons, operators tend to co-locate the different cellular systems on the same site. In most cases, it is not desirable to use the same antenna for different systems, so the operator will often have two or more antennas pointing in the same direction, one for each cellular system. Also, if the operator has a license for two or more sub-bands within the same cellular frequency band, he may prefer to use two antennas rather than combining the carriers before feeding them to a common antenna as this will eliminate the combining losses. There are several disadvantages associated with having a large number of antennas at the same site: visual impact, higher wind load, higher cost of installation, higher rental cost for the site, etc. Therefore, it is often preferred to combine several discrete antennas into one unit sharing a common radome for environmental protection as this will be perceived as one slightly larger antenna. The antennas being combined together can be antennas made for the same frequency band, or antennas made for different frequency bands.

Combined antennas already exist and are widely deployed today. Typically, two or more antennas are being mechanically attached to each other with a common radome. Today most antennas have dual polarisation, with one polarisation being oriented +45 degrees relative to the antenna vertical axis, and the other polarisation oriented −45 degrees relative to the same axis, but the phenomena described below is likely to occur also with single polarisation antennas. A well-designed antenna will have a main lobe which, in the azimuth plane, points in a direction that is perpendicular to the antenna reflector and that is symmetrical with respect to an axis perpendicular to the reflector, but when antennas are placed close to each other, scattering and diffraction phenomena will occur because of the neighbouring antenna, and these phenomena may have a negative effect on the antenna radiation pattern, especially in the azimuth plane; the azimuth lobe width may increase or decrease, or the main lobe may point in a direction that is not perpendicular to the reflector in the azimuth plane, or the main lobe may become non-symmetrical or there may be a combination of the effects described above. The antenna radiation pattern in the elevation plane is less likely to be affected by the neighbouring antenna.

The antenna azimuth lobe width is important because it affects coverage and antenna gain. It is often important to have as high gain as possible in an antenna as this increases the size of the cell, and increases the capacity of the system. A narrower lobe will increase the gain, but may lead to reduced coverage. A wider lobe will reduce the gain, and may lead to interference problems as signal from one sector may leak into the neighbouring sector. When using combined antennas, it is usually assumed that the antenna lobes of two combined antennas point in the same direction, but if the two antennas lobes point in different directions due to scattering and diffraction phenomena, this will result in deteriorated coverage or increased interference in the network.

The object of this invention is therefore to provide means to reduce the effects of scattering and diffraction in a combined antenna. This object is obtained by arranging one or more conducting elements in the form of wires or strips between the discrete antennas arranged alongside each other in a combined antenna.

This invention relates to a combined base station antenna comprising two or more discrete antennas. The discrete antennas can be designed for the same frequency band, or different frequency bands. The antennas can have fixed or variable tilt and both types of tilt can be used in the same combined antenna. A typical non-limiting realisation of such an antenna is shown in FIG. 1 where two identical dual polarised antennas have been combined. The gain and azimuth lobe width of one discrete antenna alone behaves well over frequency as can be seen in FIG. 3 showing the gain for both polarisations. But when two discrete antennas are combined mechanically together, the azimuth lobe width increases from 67 to 73 degrees at the lower frequencies, and resulting in loss of gain in the order of 0.5 dB as can be seen in FIG. 4, a quite significant loss in performance.

One or more conducting elements in the form of wires or strips arranged in parallel with the antenna longitudinal direction, between two discrete antennas arranged alongside each other, will act as a reflector, and will reduce or almost eliminate the deterioration of the antenna gain caused by the neighbouring antenna as can be seen in FIG. 5. Conducting elements such as wires or strips have also been described to be used in base station antennas, e.g. in U.S. Pat. No. 5,952,983, but the use has then only been restricted to the reduction of cross-coupling between the two polarisations in a discrete dual-polarised antenna. The mode of operation is different, the wires are typically placed in a direction perpendicular to antenna longitudinal axis, and the length of the wires is typically in the order of one half wave-length, whereas in the present invention, the wire can run along the whole length of the antenna along the antenna longitudinal axis. In US 2006/0038376 A1, a suspended wire is used to reduce coupling between two antennas of a mobile phone that share a common ground plane; a wire with a length typically in the order of one half wave-length is placed above the common ground plane.

The object of the present invention is to reduce the effects of scattering and diffraction, and uses conductive elements such as wires or strips oriented in a direction parallel with the antennas longitudinal axis and having lengths that significantly exceed one half wave-length.

BRIEF DESCRIPTION OF THE DRAWINGS

The invention will now be described in more detail in connection with a number of non-limiting embodiments of the invention shown on the appended drawings, in which.

DETAILED DESCRIPTION

Figure 1:
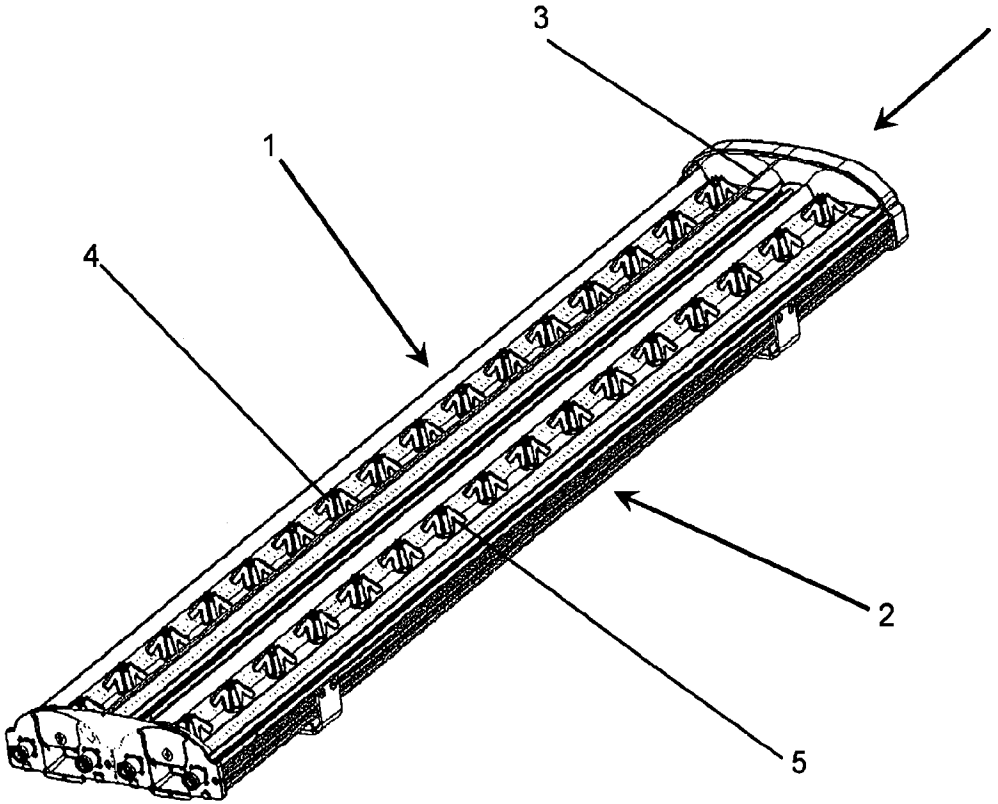
FIG. 1 shows a perspective view of a combined antenna according to the invention having a conducting wire suspended between two discrete antennas arranged alongside each other.

The principles for this invention are shown in FIG. 1. Two discrete antennas 1, 2 are combined together, and a conducting wire 3 is suspended between the two antennas, and at predefined height above the antenna reflectors 4, 5. The diameter of the wire, its position relative to the antenna reflectors 4, 5, and its length are preferably determined experimentally.

Figure 2:
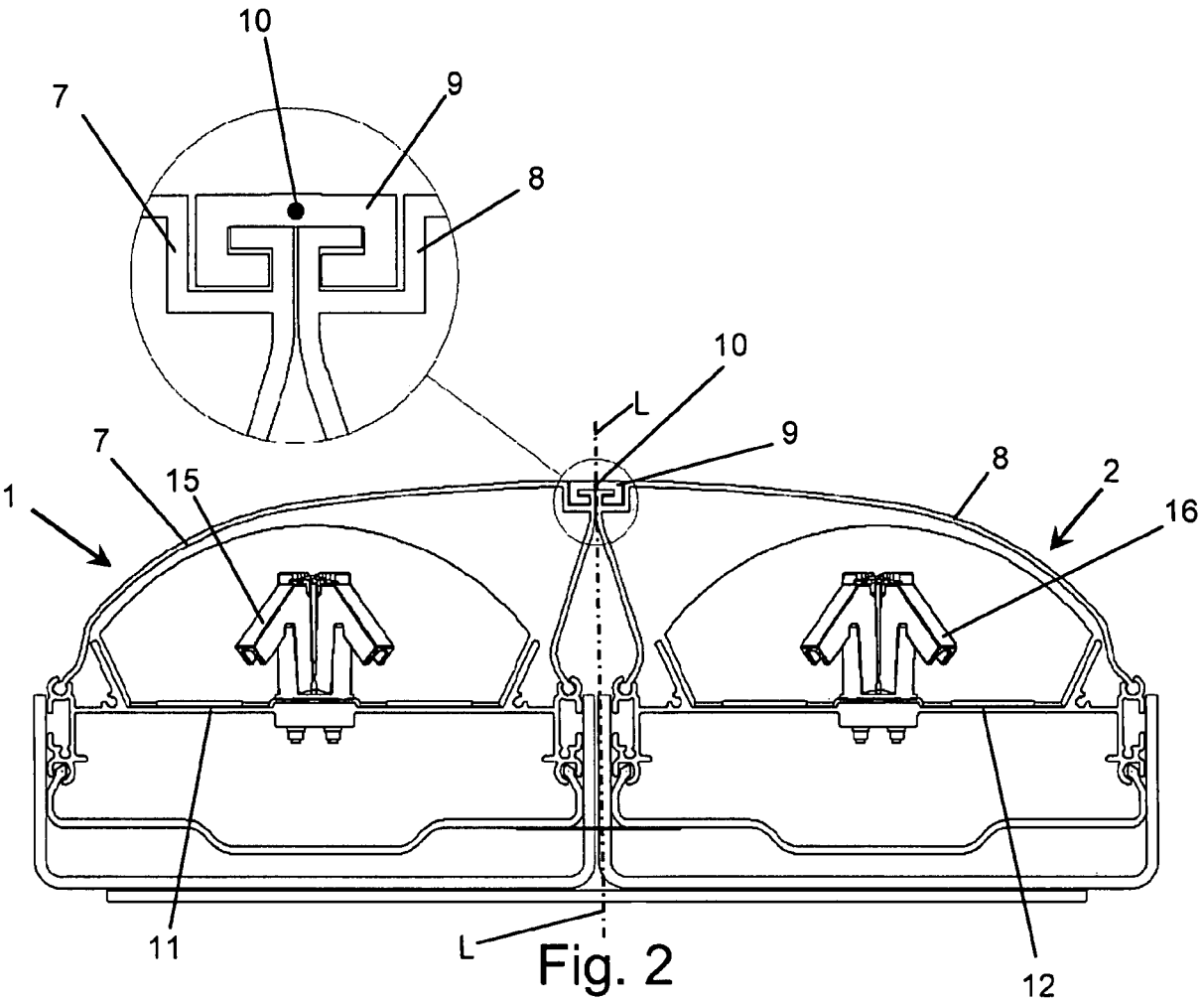
FIG. 2 shows a schematic cross section of an embodiment of a combined antenna based on two antennas having a common radome consisting of three parts, where a conducting wire has been integrated within the middle part, and showing this later part in an expanded view.

In a first embodiment shown in FIG. 2, two wide band antennas 1, 2 of the same type are combined, but the invention is not limited to using antennas of the same type, frequency band or size. Also, more than two antennas can be combined into a combined antenna 6. The antennas 1, 2 are combined by mechanically attaching them using e.g. brackets, but other ways of mechanically combining the antennas can also be used. Typically, the antennas 1, 2 will be placed close to each other, but in some cases it can be advantageous to separate the antennas. In this first embodiment, the antenna radome consists of three extruded parts; the two outer parts 7, 8 have the same shape but are mirrored around the antenna longitudinal plane L-L, and they are attached together using a third part 9. The radome parts are preferably made in a polymer material, and can be reinforced using e.g. glass fibre. A possible manufacturing process is extrusion but other manufacturing processes can also be used. A conducting wire 10 is integrated within the third part 9 of the radome. If the radome part 9 is extruded, the wire 10 can be integrated into the radome during the extrusion process.

In another embodiment, not shown, a conducting strip is attached to the third part 9 of the radome.

Figure 3:
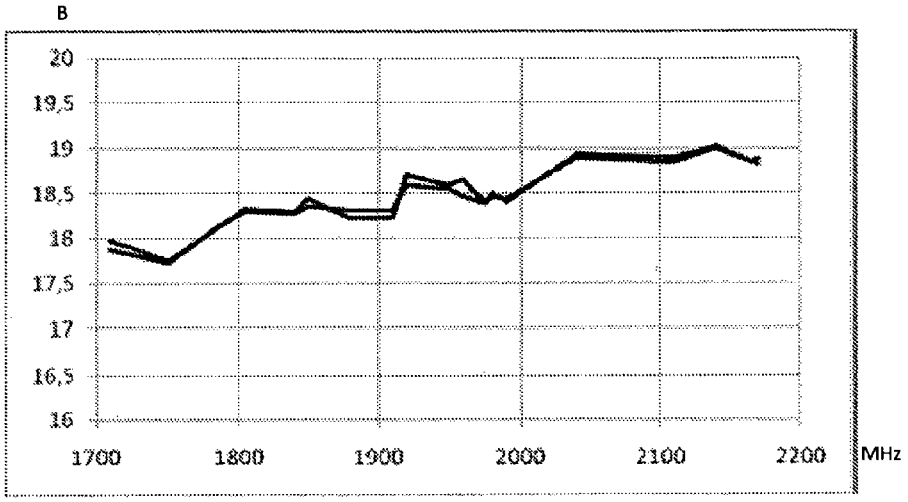
FIG. 3 shows the antenna gain for both polarisations of one of the two discrete antennas as a stand-alone antenna.

The radiation characteristics of one of the two discrete antennas used in an embodiment as described above were measured when the antenna was not combined with another antenna and the gain vs frequency is shown in FIG. 3. It can be seen that the gain increases with frequency as can be expected.

Figure 4:
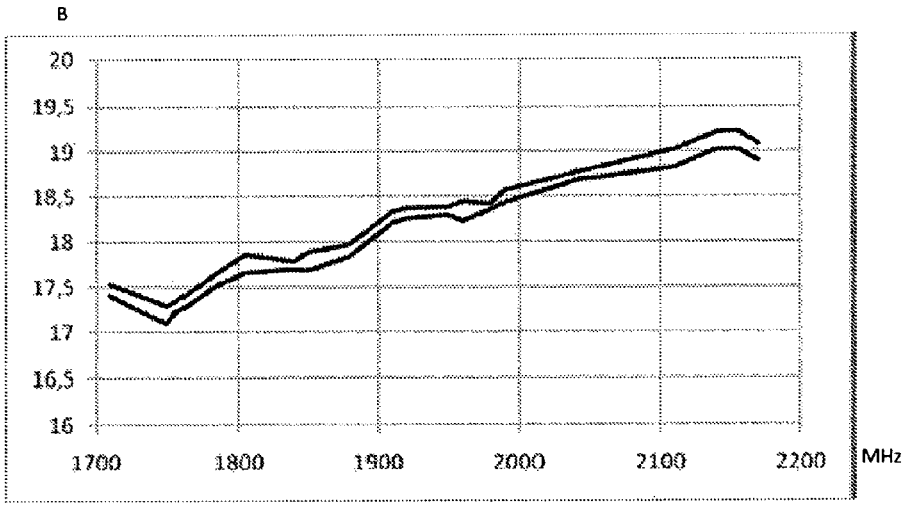
FIG. 4 shows the antenna gain for both polarisations of one of the two discrete antennas of a state-of-the-art combined antenna.
Figure 5:
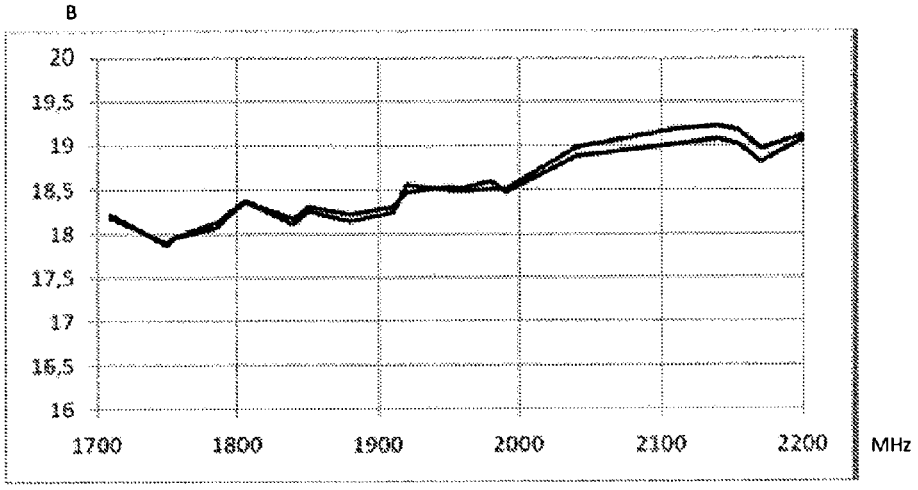
FIG. 5 shows the antenna gain for both polarisations of one of the two discrete antennas of combined antenna after a conducting wire has been arranged between the two discrete antennas arranged alongside each other and forming the combined antenna as shown in FIG. 2.

The maximum measured pointing error is 1.5 degree. Then two discrete antennas were combined according to current state-of-the-art. The measured gain of such a combined antenna is shown in FIG. 4 and it can be seen that the gain has been reduced by 0.5 dB at lower frequencies, and the maximum measured pointing error is 3.8 degrees. Then a combined antenna according to the invention and the embodiment shown in FIG. 2 was measured. It can be seen in FIG. 5 that the antenna gain again is close to that measured for the discrete antenna alone, and the maximum measured pointing error has been reduced to 2.0 degrees, which is close to the original pointing error.

Figure 6:
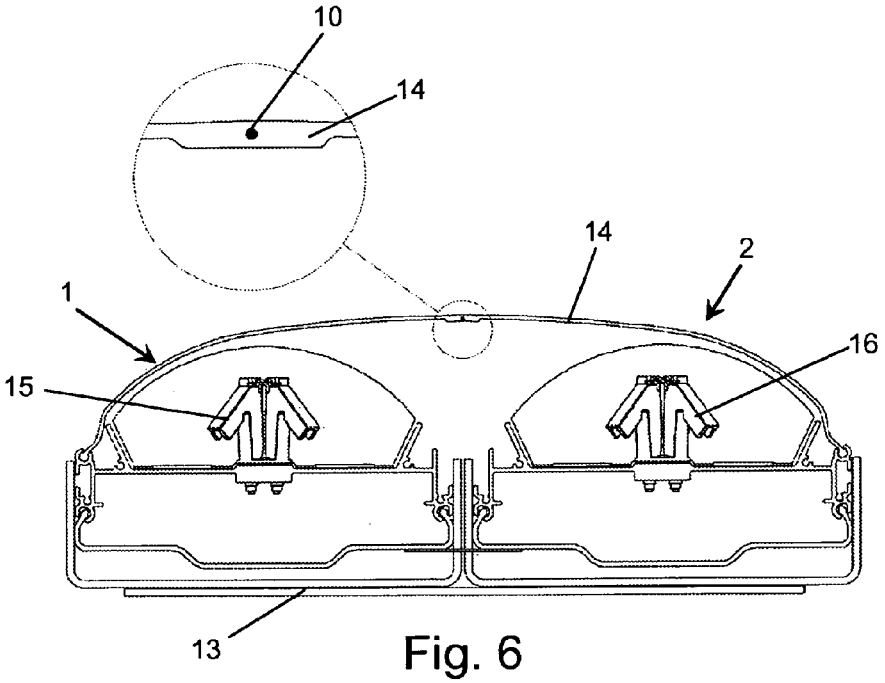
FIG. 6 shows a schematic cross section of a combined antenna in an embodiment using a one-piece radome with an integrated conducting wire, and showing the conducting wire in an expanded view.

Another embodiment of the invention is shown in FIG. 6. Two discrete antennas 1, 2 are arranged alongside each other mounted on a bracket 13 to form a combined antenna 6. The combined antenna 6 uses a common radome 14 for the discrete antennas 1, 2, the radome 14 being made in one piece. A conducting element in the form of a wire 10 is integrated within the radome 14 and extending along substantially the whole length of the combined antenna 6 and being located at the top of the radome along a separation line separating the discrete antennas 1, 2 from each other. It is, however, not necessary that the discrete antennas 1, 2 are abutting each other alongside, but they can be on some distance from each other.

Figure 7:
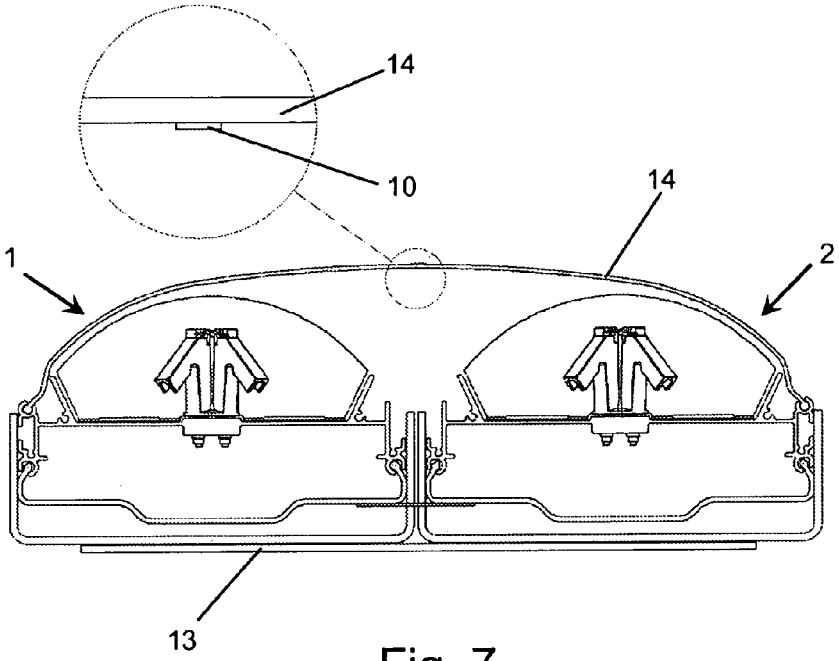
FIG. 7 shows a view corresponding to FIG. 6 but with a radome having a conducting strip attached to the inside of the radome.

In another embodiment shown in FIG. 7, two discrete antennas 1, 2 are combined and use a common radome 14 made in one piece and a conducting strip 10 is attached to the inside of the radome 14 using an adhesive or glue or another fastening means. By conducting strip is meant an essentially longitudinal conducting element having another form than a wire, such as e.g. square or rectangular form.

Figure 8:
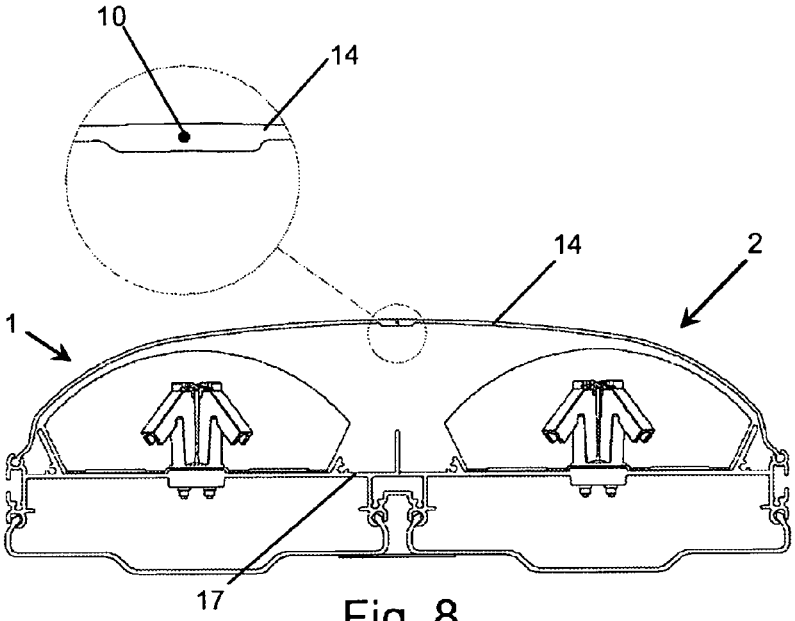
FIG. 8 shows a schematic cross section of a combined antenna in an embodiment with two separate antenna reflectors being made in one part and having a radome with an integrated conducting wire, and showing the conducting wire in an expanded view.

In another embodiment shown in FIG. 8, the two discrete antennas use reflectors made in one part 17 for the dipoles 15, 16 of the two discrete antennas 1, 2. A common radome 14 is used, covering the two discrete antennas 1, 2, and including as in FIG. 6 a conducting wire 10 at the top of the radome 14, but other types of conductors can also be used.

Figure 9:
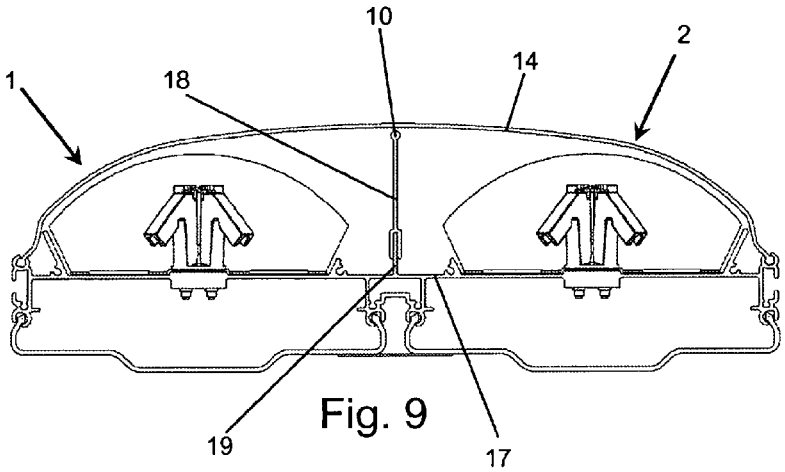
FIG. 9 shows a schematic cross section of a combined antenna in an embodiment where a conducting wire is suspended using non-conducting holders being attached to the antenna reflectors.

In another embodiment shown in FIG. 9, a combined antenna has a common reflector 17 for the two alongside each other arranged discrete antennas 1, 2. Holders 18 made of a non-conducting material such as a polymer material, are attached to a central longitudinal flange 19, separating the discrete antennas 1, 2 from each other. The holders 18 are used to suspend a conducting wire 10 that is used to reduce the effects of scattering and diffraction. The holders 18 may also be attached to the antenna reflector, or another part of the antenna.

Figure 10:
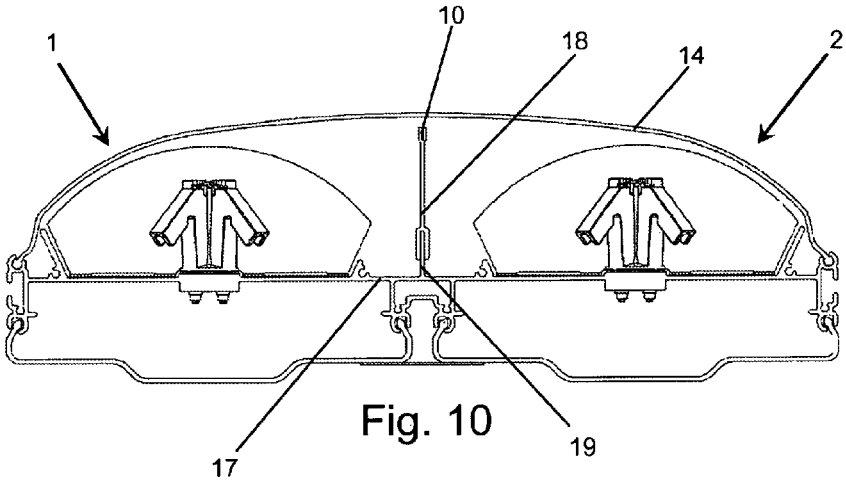
FIG. 10 shows a schematic cross section of an embodiment where a conducting strip is suspended using non-conducting holders being attached to the antenna reflectors.

In another embodiment shown in FIG. 10, similar to that in FIG. 9, a combined antenna with a common reflector 17 uses holders 18 to suspend a conducting strip 10.

Figures 11, 12, 13:
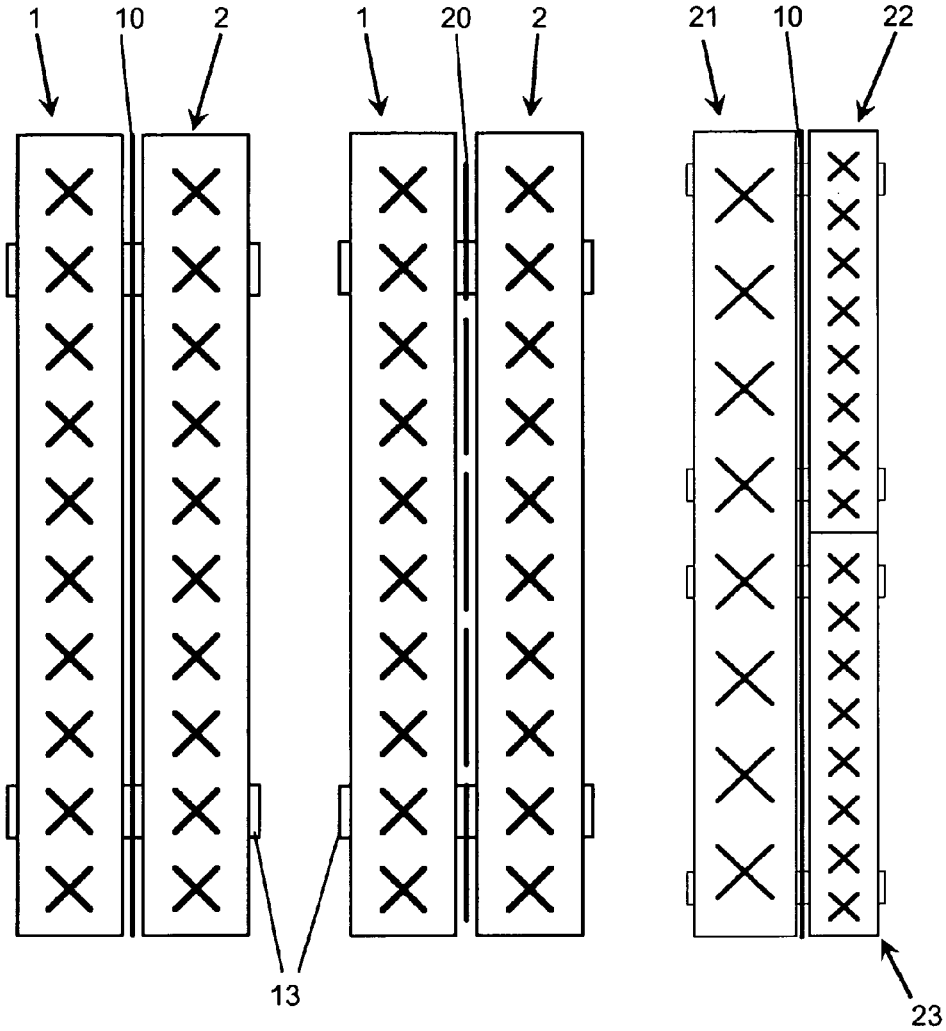
FIG. 11 shows a schematic planar view of an embodiment with two similar discrete antennas and a conducting wire between the two discrete antennas.
FIG. 12 shows a schematic planar view of an embodiment with two similar discrete antennas and several conducting wires placed between the two discrete antennas.
FIG. 13 shows a schematic planar view of an embodiment of a triple-band antenna with one long discrete antenna for lower frequencies, and two short discrete antennas for higher frequencies.

FIG. 11 shows how the conducting element 10 used extends along the whole length of the combined antenna consisting of two similar antennas 1, 2 arranged alongside each other, but a conductor that does not extend along the whole length of the combined antenna can also be used. It is also possible to use a number of discrete conducting element parts 20 of a minor length, as shown in FIG. 12.

FIG. 13 shows an embodiment with one low frequency antenna 21, e.g. for the GSM 900 MHz band, being placed alongside and combined with two similar antennas 22,23 for higher frequencies, e.g. the DCS 1800 MHz band and the UMTS 2100 MHz band.

The two antennas 22, 23 are located one at the end of the other, but with one of their longitudinal sides alongside one of the longitudinal sides of the low frequency antenna 21. The conducting element 10 extends along the separation line between the low frequency antenna 1 and the two antennas 22, 23, but the location of the conducting element 10 has to be optimised experimentally, and the optimal location may not be along the separation line between the two antennas, but rather with an offset relative to this separation line.

In another embodiment, not shown, the combined antennas may not point in the same direction, but in directions differing by a pre-defined angle in the azimuth plane. In such an embodiment, the means for mechanically attaching the discrete antennas can be made in such a way that antenna reflectors of the discrete antennas are not parallel to each other.

In the presented embodiments, the combined antenna has a common radome, but the invention is not limited to antennas having a combined radome, it is also possible to combine one or more antennas each having its own radome.

Several embodiments have been described, but the invention is not limited to these embodiments; other combinations of the described embodiments can also be used.

Using a radome in three parts 7, 8, 9 as shown in FIG. 2 can be advantageous also in the case when a conducting element is not used. An extruded large radome 14 as shown in FIG. 7. requires a large machine for manufacturing, and this reduces the number of possible suppliers. Tooling cost is high, and because of the reduced number of suppliers, lead time can be long. The three part radome as shown in FIG. 2 provides for more flexibility and reduces cost and lead time for providing radomes for antennas of different sizes.

The invention claimed is:

1. An antenna arrangement comprising:

two discrete linear array antennas (1, 2) comprising linearly arranged radiators, the linear array antennas mechanically attached to each other to form a combined base station antenna (6), wherein the two discrete linear array antennas (1, 2) in said combined base station antenna (6) are located alongside and parallel to each other; and a linear conducting element (10) extending substantially the length of said two linear array antennas and located parallel to said two linear array antennas (1, 2) between the two linear array antennas (1, 2) at a height above at least one reflector (4, 5, 11, 12, 17) on which said radiators are mounted.

2. The antenna arrangement according to claim 1, the discrete linear array antennas (1, 2) in said combined base station antenna (6) are arranged on separated reflectors (11, 12).

3. An antenna arrangement comprising:

two discrete linear array antennas (1, 2) comprising radiators arranged linearly on reflectors being made in one part (17) to form a combined base station antenna (6), the two linear array antennas (1, 2) in said combined base station antenna (6) are located alongside and parallel to each other; and a linear conducting element (10) extending substantially the length of said two linear array antennas and arranged parallel to and between the discrete linear array antennas (1, 2).

4. The antenna arrangement according to claim 1, the conducting element (10) is integrated within an antenna radome (7, 8, 9, 14) covering said combined base station antenna (6).

5. The antenna arrangement according to claim 1, the conducting element (10) is attached to an antenna radome (14) covering said combined base station antenna (1, 2).

6. The antenna arrangement according to claim 1, the conducting element (10) is arranged on non-conducting holders (18) attached to a reflector (17) of said combined base station antenna (6).

7. The antenna arrangement according to claim 1, the conducting element (10) is in the form of a wire.

8. The antenna arrangement according to claim 1, the conducting element (10) is in the form of a strip.

9. The antenna arrangement according to claim 1, the conducting element (10) has a length substantially corresponding to the length of the combined base station antenna (6).

10. The antenna arrangement according to claim 1, conducting element is divided into a number of discrete conducting element parts (20).

11. The antenna arrangement according to claim 1, reflectors for the discrete linear array antennas (1, 2) in said combined antenna (6) are arranged in an angle to each other.

12. The antenna arrangement according to claim 3, the conducting element (10) is integrated within an antenna radome (7, 8, 9, 14) covering said combined base station antenna (6).

13. The antenna arrangement according to claim 3, the conducting element (10) is attached to an antenna radome (14) covering said combined base station antenna (1, 2).

14. The antenna arrangement according to claim 3, the conducting element (10) is arranged on non-conducting holders (18) attached to a reflector (17) of said combined base station antenna (6).

15. The antenna arrangement according to claim 3, the conducting element (10) is in the form of a wire.

16. The antenna arrangement according to claim 3, the conducting element (10) is in the form of a strip.

17. The antenna arrangement according to claim 3, the conducting element (10) has a length substantially corresponding to the length of the combined base station antenna (6).

18. The antenna arrangement according to claim 3, conducting element is divided into a number of discrete conducting element parts (20).

* * * * *